US006744025B2

(12) United States Patent
Vilo

(10) Patent No.: US 6,744,025 B2
(45) Date of Patent: Jun. 1, 2004

(54) APPARATUS FOR HOT-PRESSING A PLANAR PRODUCT

(75) Inventor: Jaakko Vilo, Nastola (FI)

(73) Assignee: Raute Oyj, Nastola (FI)

( * ) Notice: Subject to any disclaimer, the term of this patent is extended or adjusted under 35 U.S.C. 154(b) by 0 days.

(21) Appl. No.: 10/361,085

(22) Filed: Feb. 10, 2003

(65) Prior Publication Data

US 2003/0155351 A1 Aug. 21, 2003

(30) Foreign Application Priority Data

Feb. 18, 2002 (FI) ..... 20020321

(51) Int. Cl.[7] ..... H05B 6/78

(52) U.S. Cl. ..... 219/686; 219/700; 219/701; 219/756; 100/306; 156/379.6; 425/174.8 R; 34/259; 419/48

(58) Field of Search ..... 219/686, 700, 219/701, 698, 699, 756, 762; 100/301, 306; 34/259, 264, 262; 156/272.2, 273.7, 379.6, 380.6; 425/174, 174.8 R, 174.8 E; 419/48, 52

(56) References Cited

U.S. PATENT DOCUMENTS 4,186,044 A * 1/1980 Bradley et al. ..... 156/275.5
4,456,498 A 6/1984 Churchland
4,879,444 A * 11/1989 Bichot et al. ..... 219/684
4,999,469 A * 3/1991 Dudley et al. ..... 219/693
5,160,819 A * 11/1992 Ball et al. ..... 219/700
5,767,493 A 6/1998 Lautenschlager

FOREIGN PATENT DOCUMENTS

EP 0329388 A2 8/1989
FI 79010 6/1989

* cited by examiner

*Primary Examiner*—Philip H. Leung
(74) *Attorney, Agent, or Firm*—Connolly, Bove Lodge & Hutz LLP

(57) ABSTRACT

The invention relates to an apparatus for hot-pressing a planar product in a process using microwave heating. The apparatus comprises a constant-volume, box-like microwave resonant cavity divided into two opposed subcavities by an elongated gap suitable for passing therethrough the product (1) to be heated. The product is guided through the gap by conveyor belts (2, 2') of microwave-transparent material. The subcavities are delineated from the conveyor passageway gap by parallel walls of microwave-transparent material, each one of them sealed so as to form a wall of its own subcavity. At least one of the subcavities is pressurized, whereby the sealed wall of the pressurized subcavity is designed to yield under the pressure applied into the subcavity in a direction perpendicular to the product (1) to be pressed.

4 Claims, 1 Drawing Sheet

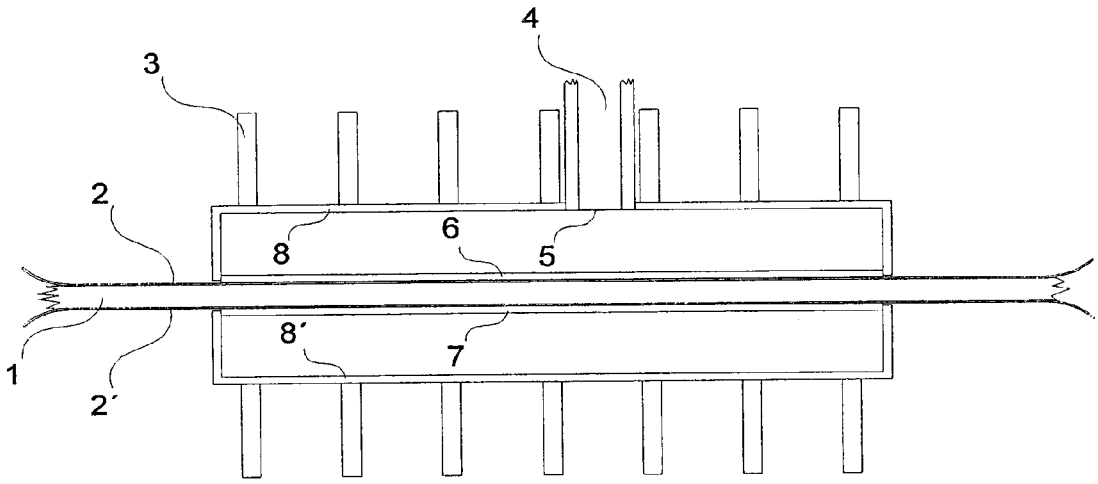
4
3
2
6
8
5
8´
7
1
2´

APPARATUS FOR HOT-PRESSING A PLANAR PRODUCT

The invention relates to an apparatus for hot-pressing a planar product in a process using microwave heating.

Heating of planar wood products containing glue layers up to the curing temperature of the glue using microwave heating is known in the art. Apparatuses based on this heating technique have the heating unit formed into a box-like resonant cavity via which the product to be heated is passed. The product is passed via a narrow gap that extends lengthwise through the entire cavity and in which gap the product travels conventionally supported by conveyor belts. The material of the belts is selected to be transparent to microwave radiation.

After the heating step, the product is generally passed to a press apparatus, wherein the throughout heated product is pressed to its target thickness and the glue is cured by the latent heat of the product.

Conventional processes have rarely used pressing during the heating step due to the limitations set by the basic construction of the microwave heating system. Microwave energy must be contained in a resonant cavity through which the product being heated is passed. To establish resonant conditions in the cavity, its walls must be spaced at a given distance from each other. This constraint excludes the possibility of moving the parts of the resonant chamber in regard to each other in order to accomplish the pressing step. A certain degree of compressive pressure has been imposed in the prior art on the product during the heating step by way of arranging press rolls on the opposite side of the conveyor belts traveling through the resonant cavity such that the rolls have been able to press the conveyor belts against the product being heated. This embodiment, however, is limited by the belt material durability as to the maximum applicable pressure and, moreover, to the uniform distribution of the pressure imposed over the product surface. The belt material must be selected transparent to microwaves, whereby the use of metallic belts for instance is excluded.

Now, an improvement according to the invention is offered to ovecome such problems by virtue of an apparatus comprising in a conventional fashion a constant-volume, box-like microwave resonant cavity suitable for division into two opposed subcavities by an elongated gap suitable for passing therethrough the product to be heated and conveyor belts of microwave-transparent material for guiding the product to be heated through the gap, whereby the subcavities are delineated from the conveyor passageway gap by parallel walls of microwave-transparent material, each one of them sealed so as to form a wall of its own subcavity, of which subcavities at least one is pressurized and that the sealed wall of the at least one pressurized subcavity is designed to yield under the pressure applied into the subcavity in a direction perpendicular to the product to be pressed.

Such pressurization of at least one of the opposed subcavities of the resonant cavity makes it possible to apply to the conveyor belts a moderate, uniformly distributed pressing force that allows the product to be pressed in a desired fashion already during the heating step of the product.

Next, the invention will be examined in greater detail by making reference to the appended drawing, wherein an apparatus according to the invention is shown in a sectional side elevation view.

Referring to the diagram, therein is shown a constant-volume resonant cavity that in the illustrated embodiment is divided substantially at the midline of the cavity into two opposed subcavities separated from each other by a gap defined by walls 6 and 7 outdistanced from each other. A product 1 to be heated is passed via the slot-like space remaining between the subcavity walls 6 and 7, between conveyor belts 2 and 2' of the apparatus in a sliding contact with the subcavity walls 6 and 7. The force required for pressing the product is accomplished by pressurizing at least one of the subcavities, particularly through applying compressed air at a given pressure to the subcavity or subcavities. The subcavity wall 6 and/or 7 delineating the pressurized subcavity from intercavity gap must be given a structural elasticity such that it yields at least to some degree under the pressure of the compressed air applied into the subcavity sealed by the wall, thus allowing a pressing force to be applied to the conveyor belt facing the subcavity and therethrough to the product 1. If only one of the subcavities is intended to be pressurizable, obviously the wall 6 or 7, respectively, of the opposed subcavity must be made structurally so rigid that it does not substantially yield under the pressure load imposed by the opposed, pressurized subcavity.

In lieu using an elastic structure, the facing walls 6 and 7 of the subcavities can be constructed such that a sealed movement of the walls in their respective subcavities with a slidable fit is possible in order to impose the pressing effect accomplished by means of the pressure prevailing in the subcavity to the respective conveyor belt and therethrough further to the product being treated.

To reduce the sliding friction, compressed air may be passed to the interface between the conveyor belts 2, 2' and the respective subcavity walls 6, 7, e.g., by admitting air leakage from the respective subcavities.

An alternative embodiment may be contemplated such that uses the conveyor belts 2, 2' for sealing the pressurized space of a subcavity from the conveyor passageway gap. Herein, the side of the pressurized subcavity space facing the conveyor gap passageway is sealed with a low-friction edge seal along which the conveyor belts are passed through the conveyor passageway gap in a sealed sliding contact.

The heating energy to be imposed on the product is introduced thereby by microwave radiation passed via a waveguide duct 4 that terminates at an opening 5 of the subchamber and is hermetically sealed by microwave-transparent material.

The apparatus can be designed to operate in continuous manner. Alternatively an intermittent operation can also be used to accomplish the invention.

What is claimed is:

1. An apparatus for hot-pressing a planar product in a process using microwave heating, said apparatus comprising a constant-volume, box-like microwave resonant cavity divided into two opposed subcavities by an elongated gap suitable for passing therethrough the product (1) to be heated and conveyor belts (2, 2') of microwave-transparent material for guiding the product to be heated through the gap, characterized in that the subcavities are delineated from the conveyor passageway gap by parallel walls of microwave-transparent material, each one of them sealed so as to form a wall of its own subcavity, of which subcavities at least one is pressurized and that the sealed wall of said at least one pressurized subcavity is designed to yield under the pressure applied into the subcavity in a direction perpendicular to the product to be pressed.

2. The apparatus of claim 1, characterized in that said pressurized subcavity is delineated from the conveyor passageway gap by an elastic wall (6, 7).

3. The apparatus of claim 1, characterized in that said pressurized subcavity is delineated from the conveyor passageway gap by an wall (6, 7) movable in said subcavity in a sliding-fit contact.

4. The apparatus of claim 1, characterized in that said pressurized subcavity is delineated from the conveyor passageway gap by a conveyor belt (2, 2') running along the borders of said subcavity in a sliding contact.

* * * * *